US008662738B2

(12) United States Patent
Kawate et al.

(10) Patent No.: US 8,662,738 B2
(45) Date of Patent: Mar. 4, 2014

(54) LIQUID STORAGE CONTAINER MOUNTED ON LIQUID EJECTING APPARATUS

(75) Inventors: Hiroyuki Kawate, Hokuto (JP); Masaru Takahashi, Matsumoto (JP); Taku Ishizawa, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 82 days.

(21) Appl. No.: 13/361,899

(22) Filed: Jan. 30, 2012

(65) Prior Publication Data

US 2012/0195158 A1 Aug. 2, 2012

(30) Foreign Application Priority Data

Jan. 31, 2011 (JP) ..... 2011-017645

(51) Int. Cl.
*B01F 11/00* (2006.01)

(52) U.S. Cl.
USPC ..... 366/212; 366/276

(58) Field of Classification Search
USPC ..... 374/85, 39; 366/114, 118, 208, 212, 366/129, 197, 348, 342, 130, 218, 276
See application file for complete search history.

(56) References Cited

U.S. PATENT DOCUMENTS

| | | | | |
|---|---|---|---|---|
| 1,622,298 | A * | 3/1927 | Wahl | 366/118 |
| 7,618,133 | B2 | 11/2009 | Kubo et al. | |
| 7,661,563 | B2 * | 2/2010 | De Lataulade | 366/130 |
| 2007/0052768 | A1 | 3/2007 | Ohashi et al. | |
| 2007/0052769 | A1 | 3/2007 | Kubo et al. | |

FOREIGN PATENT DOCUMENTS

| | | | |
|---|---|---|---|
| EP | 1854633 | A2 | 11/2007 |
| JP | 2005-066520 | A | 3/2005 |
| JP | 2007-069351 | A | 3/2007 |

* cited by examiner

*Primary Examiner* — Tony G Soohoo
*Assistant Examiner* — Anshu Bhatia
(74) *Attorney, Agent, or Firm* — Kilpatrick Townsend & Stockton LLP

(57) ABSTRACT

A liquid storage container which is mounted on a carriage of a liquid ejecting apparatus ejecting a liquid while reciprocating the carriage on which an ejecting head is provided and supplies the liquid to the ejecting head includes a liquid storage chamber configured to store the liquid therein, a stirring member has a stirring surface and provided in the liquid storage chamber in a state capable of being swung by the reciprocation of the carriage, a support member that supports the stirring member, and a first buffer member is provided between the support member and the stirring member.

9 Claims, 7 Drawing Sheets

LIQUID STORAGE CONTAINER MOUNTED ON LIQUID EJECTING APPARATUS

Priority is claimed under 35 U.S.C. §119 to Japanese Application No. 2011-017645 filed on Jan. 31, 2011 which is hereby incorporated by reference in its entirety.

BACKGROUND

1. Technical Field

The present invention relates to a liquid storage container which is applied to a liquid ejecting apparatus ejecting a liquid such as ink and stores the liquid therein.

2. Related Art

A printing apparatus which prints an image by ejecting ink onto a printing medium is widely used. In the printing apparatus, the image is printed by ejecting the ink from an ejecting head while reciprocating a carriage on which the ejecting head is provided on the printing medium. Moreover, the ejected ink is stored in an exclusive storage container referred to as an ink cartridge and mounted on the carriage.

When components (pigments or the like) having a greater specific gravity than a solvent are included in the ink which is stored in the ink cartridge, the components settle by gravity as time passes and variation in concentration of the ink is generated. Therefore, a stirring mechanism of ink is provided in an ink storage chamber of the ink cartridge. For example, the stirring mechanism includes a plate-shaped stirring member which is provided in the ink storage chamber, a supporting member which supports the stirring member in the ink storage chamber, and the like. A notch is provided at one end of the stirring member, and the stirring member is swingably supported by engaging the notch to the supporting member. If the ink cartridge including the ink stirring mechanism is mounted on the carriage, the stirring member is swung by reciprocation of the carriage, and the ink can be stirred by the movement of the stirring member (JP-A-2007-69351).

However, when the above-described stirring mechanism of JP-A-2007-69351 is adopted, there is a problem in that noise generated due to stirring of the ink may be very large.

SUMMARY

An advantage of some aspects of the invention is to provide a technology capable of controlling noise generated due to an operation of a stirring member which is provided in an ink cartridge.

According to an aspect of the invention, there is provided a liquid storage container which is mounted on a carriage of a liquid ejecting apparatus ejecting a liquid while reciprocating the carriage on which an ejecting head is provided and supplies the liquid to the ejecting head including a liquid storage chamber that stores the liquid therein, a stirring member that is provided in the liquid storage chamber, and a support structure that supports the stirring member in a state where the stirring member can swing, wherein the stirring member is a member which is provided in the liquid storage chamber in a state capable of being swung by the reciprocation of the carriage, and in which a stirring surface, which stirs the liquid in the liquid storage chamber by the swinging at the liquid storage chamber, is formed on at least a portion of the stirring member, and a first buffer member is provided between the supporting structure and the stirring member.

According to the liquid storage container of the aspect of the invention, the stirring member swings in the liquid storage chamber by the reciprocation of the carriage if the liquid storage container is mounted on the carriage. In addition, according to the liquid storage container of the aspect of the invention, the first buffer member is provided between the supporting structure which supports the stirring member in the state where the stirring member can swing and the stirring member.

Since the liquid in the liquid storage chamber is stirred by the stirring surface if the stirring member swings, a concentration of the liquid in the liquid storage chamber can be uniformly held. In addition, due to the fact that the first buffer member is provided between the supporting structure which supports the stirring member in the state where the stirring member can swing and the stirring member, collision noise, which is generated between the support structure and the stirring member by a vibration of the stirring member with respect to the support structure generated due to the fact that the stirring member collides with the wall surface of the liquid storage chamber, can be decreased. Thereby, the noise according to the operation of the stirring member provided in the liquid storage container is suppressed.

In the liquid storage container of the aspect of the invention, first, a hole or a notch may be provided on at least a portion of the stirring member, and the stirring member may be swingably supported in the liquid storage chamber due to the fact that the hole or the notch is engaged to a protrusion which is provided in the liquid storage chamber and is the support structure. In addition, the buffer member may be provided between the hole or the notch of the stirring member and the protrusion which is engaged to the hole or the notch and is the support structure. Moreover, the buffer member may be mounted on the hole or the notch, or on the protrusion, and may be separately mounted on the hole, the notch, or the protrusion.

Thereby, since the impact when the hole or notch of the stirring member abuts the protrusion can be absorbed, it is possible to effectively suppress the noise during the stirring of the liquid. In addition, since a liquid stirring mechanism can be assembled by only engaging the hole or the notch of the stirring member to the protrusion, it is possible to stir the liquid in the liquid storage chamber, and the assembly operation of the liquid storage container is not complicated.

In addition, in the liquid storage container of the aspect of the invention, a second buffer member may be provided on either of the stirring surface of the stirring member or a surface which faces the stirring surface at an inner surface of the liquid storage chamber.

Thereby, an abutting sound, which is generated when the stirring member moves in the direction of stirring the liquid and abuts the liquid storage container, can be also suppressed. As a result, it is possible to further effectively suppress the noise when the liquid is stirred.

Moreover, in the liquid storage container of the aspect of the invention, the first buffer member may be provided on an inner edge portion of the hole of the stirring member. Thereby, the noise according to the operation of the stirring member which is provided in the liquid storage container is suppressed.

In addition, in the liquid storage container of the aspect of the invention, the first buffer member may be provided at the protrusion. Thereby, the noise according to the operation of the stirring member which is provided in the liquid storage container is suppressed.

In addition, in the liquid storage container of the aspect of the invention, the first buffer member may be provided at the inner edge portion of the hole of the stirring member. Thereby, the noise according to the operation of the stirring member which is provided in the liquid storage container is suppressed.

According to another aspect of the invention, there is provided a liquid storage container which is mounted on a carriage of a liquid ejecting apparatus ejecting a liquid while reciprocating the carriage on which an ejecting head is provided and supplies the liquid to the ejecting head including a liquid storage chamber that stores the liquid therein, a stirring member that is provided in the liquid storage chamber, and a support structure that supports the stirring member in a state where the stirring member can swing, wherein the stirring member is a member which is provided in the liquid storage chamber in a state capable of being swung by the reciprocation of the carriage, and in which a stirring surface, which stirs the liquid in the liquid storage chamber by the swing at the liquid storage chamber, is formed on at least a portion of the stirring member, and the support structure is formed of rubber.

According to the liquid storage container of the aspects of the invention, the noise according to the operation of the stirring member which is provided in the liquid storage container is suppressed, it is not necessary to provide the buffer member as the separated member, and therefore, the number of parts can be reduced.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, in order to explain the contents of the above-described invention, embodiments will be explained according to the following order.

A. Configuration of Ink Cartridge

B. Reason why Collision Noise due to Stirring of Ink is Suppressed

C. Modification

C-1. First Modification

C-2. Second Modification

C-3. Third Modification

C-4. Fourth Modification

A. Configuration of Ink Cartridge

Figure 1:
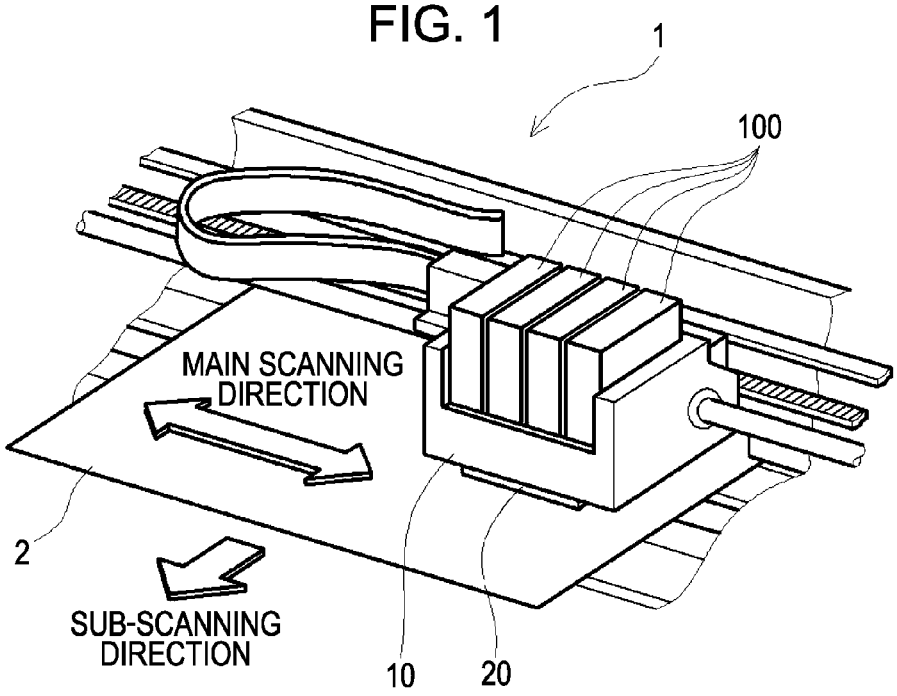
FIG. 1 is a perspective view exemplifying a state where an ink cartridge is mounted on a carriage of an ink jet printer.

FIG. 1 is an explanatory view exemplifying a state where an ink cartridge 100 is mounted on a carriage 10 of an ink jet printer 1. As shown in FIG. 1, the carriage 10 which reciprocates on a printing medium 2 is provided on the ink jet printer, and the ink cartridge 100 is mounted on the carriage 10. An ejecting head 20 which ejects the ink is provided in a lower surface side (side facing the printing medium 2) of the carriage 10 for each ink cartridge 100, and the ink stored in the ink cartridge 100 is supplied to the ejecting head 20 and ejected from the ejecting head 20 toward the printing medium 2. Moreover, the ink jet printer 1 prints an image by using cyan ink (C ink), magenta ink (M ink), yellow ink (Y ink), and black ink (K ink). According to this, four ink cartridges 100 of the ink cartridge 100 which stores the C ink, the ink cartridge 100 which stores the M ink, the ink cartridge 100 which stores the Y ink, and the ink cartridge 100 which stores the K ink are mounted on the carriage 10.

Figure 2A:
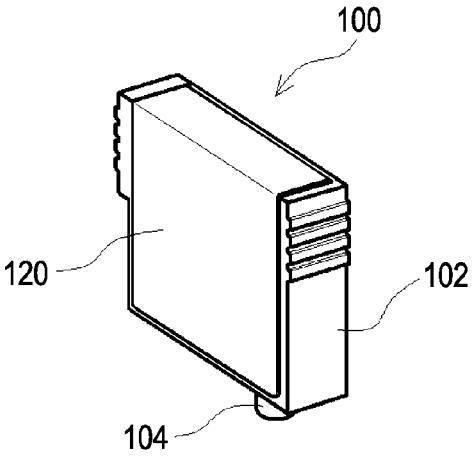
FIGS. 2A and 2B are perspective views showing an appearance configuration of the ink cartridge.
Figure 2B:
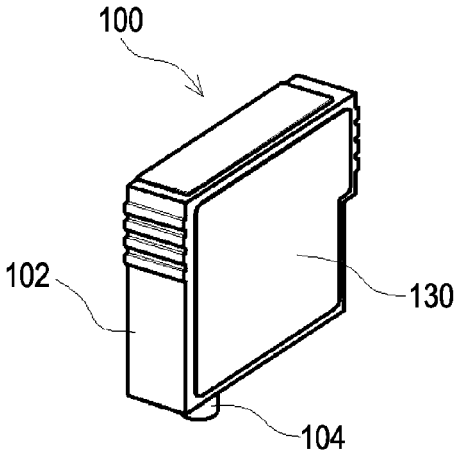

FIGS. 2A and 2B are perspective views showing an appearance configuration of the ink cartridge 100 which mounted on the carriage 10. As shown in FIGS. 2A and 2B, the ink cartridge 100 is an approximately rectangular shape, and a cartridge main body 102 is formed of a hard resin material. Moreover, as shown in FIG. 2A, in each ink cartridge 100, a display label 120 is stuck so as to be bent from the front side surface to the upper surface.

In addition, as shown in FIG. 2B, a sealing film 130 is stuck to the rear side surface of the ink cartridge 100, and the sealing film 130 is covered from the outside of the ink cartridge 100 by a cover (not shown). As described below, the rear side surface of the ink cartridge 100 is opened, and the ink can be stored in the ink cartridge 100 for the first time by sticking the sealing film 130 on the opening and sealing the ink. Moreover, an ink supply port 104 for supplying the ink toward the ejecting head 20 of the carriage 10 is provided on the bottom surface of the ink cartridge 100.

Figure 3:
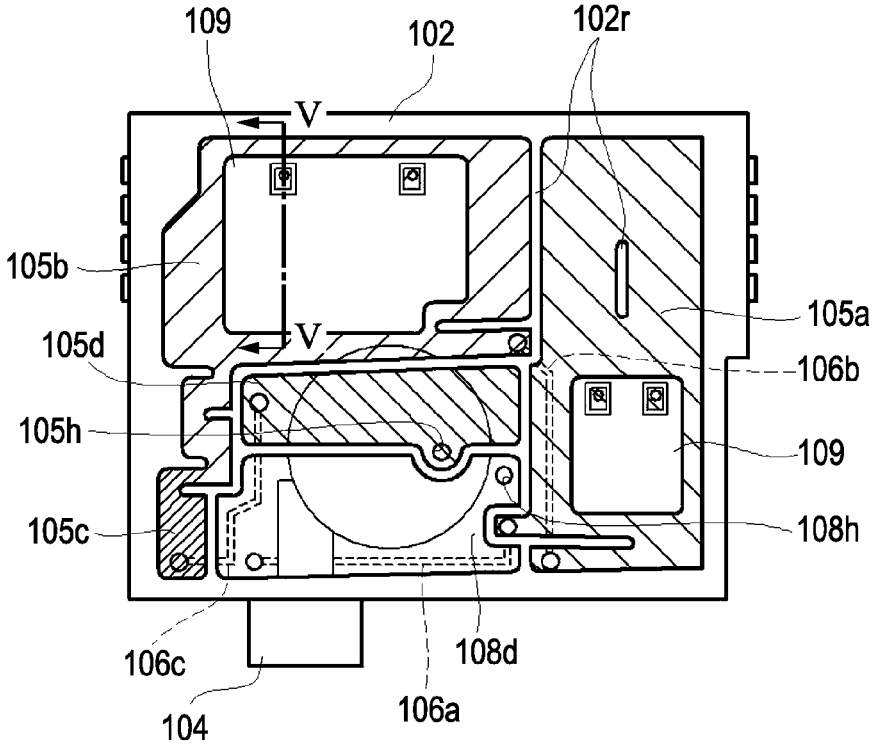
FIG. 3 is a plan view showing an inner structure of the ink cartridge by peeling a sealing film which is stuck to a rear side of the ink cartridge.

FIG. 3 is a plan view showing the inner structure of the ink cartridge 100 by peeling the sealing film 130 which is stuck to the rear side surface of the ink cartridge 100. As shown in FIG. 3, if the sealing film 130 which is stuck to the rear side of the ink cartridge 100 is peeled, a largely opened concave portion 105 appears. In addition, the concave portion 105 is largely divided into four regions of regions 105*a* to 105*d* by a plurality of ribs 102*r* which is vertically and horizontally provided. Moreover, the ink chamber which stores the ink is formed between the concave portion 105 and the sealing film 130 by sticking the sealing film 130 onto the rear side of the ink cartridge 100 and sealing the concave portion 105.

Here, with reference to FIG. 3, four regions (accordingly, configuration of ink chamber) configuring the concave portion 105 is simply explained. As shown by an oblique line in FIG. 3, the region 105*a* which becomes a first ink chamber is provided at the right side of FIG. 3, and the region 105*b* which becomes a second ink chamber is provided at the upper left of FIG. 3. The region 105*c* shown by a finely oblique line is provided at the lower left in FIG. 3 with respect to the region 105*b* which becomes the second ink chamber. The region 105*c* includes a sensor (not shown) and becomes a sensor chamber. In addition, the region 105*d* which becomes a buffer chamber is obliquely provided to the upper right of the region 105*c* which becomes the sensor chamber. Moreover, the region 105*d* which becomes the buffer chamber communicates with a pressure regulation chamber 107 by a small round communicating hole 105*h*. A membrane valve, a spring (all not shown), and the like are housed in the pressure regulation chamber 107, and the pressure regulation chamber includes a function which regulates pressure of the ink supplied to the carriage 10.

Moreover, the first ink chamber (region 105*a* in FIG. 3) and the second ink chamber (region 105*b* in FIG. 3) are connected to each other by a connecting passage 106*b*, the second ink chamber (region 105*b*) and the sensor chamber (105*c* in FIG. 3) are connected to each other by a maze-like passage, and the sensor chamber (region 105*c*) and the buffer chamber (105*d* in FIG. 3) are connected to each other by a connecting passage 106*c*. Accordingly, when the ink is ejected from the ejecting head 20, after the ink flows from the communicating hole 105*h* into the pressure regulation chamber 107 via the second ink chamber, the sensor chamber, and the buffer chamber from the first ink chamber, the ink is supplied from the ink supply port 104 to the ejecting head 20.

Moreover, in the ink cartridge 100 of the present embodiment, a stirring plate 109 made of stainless-steel for stirring the ink is provided at the inner portions of the region 105*a* which becomes the first ink chamber and the region 105*b* which becomes the second ink chamber respectively. An ink stirring mechanism including the stirring plate 109 will be described in detail hereinafter.

In addition, as shown in FIG. 3, a region 108*d* which becomes an air chamber is provided at the lower left in FIG. 3 with respect to the region 105*a* which becomes the first ink chamber. A communicating hole 108*h* is provided at the region 108*d*, and as described hereinafter, the communicating hole is connected to a hole open to the atmosphere via an air passage which is provided at the front side of the ink cartridge 100. In addition, the region 108*d* which becomes an air chamber is connected to the region 105*a*, which becomes the above-described first ink chamber, by a connecting passage 106*a*. When the ink flows backward to the hole open to the atmosphere from the first ink chamber (region 105*a*) due to the fact that the air in the ink cartridge 100 is expanded by an ambient temperature change, a posture of the ink cartridge 100 is changed, or the like, the air chamber (region 108*d* in FIG. 3) traps the ink in the inner portion and prevents the ink from being leaked to the outside.

Figure 4:
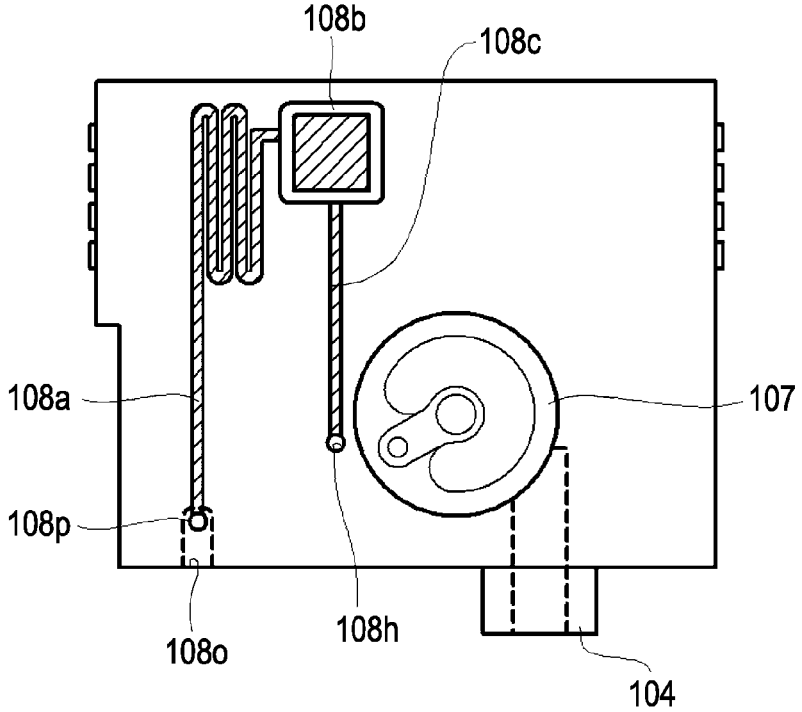
FIG. 4 is a plan view showing the inner structure of the ink cartridge by peeling a display label which is stuck to a front side of the ink cartridge.

FIG. 4 is a plan view showing the inner structure of the ink cartridge 100 by peeling the display label 120 which is stuck to the front side of the ink cartridge 100. As shown in FIG. 4, an elongated groove 108 appears if peeling the display label 120 attached to the front side of the ink cartridge 100. In FIG. 4, the groove 108 is indicated by an oblique line. The groove 108 includes a communicating hole 108*p* which communicates with a hole open to the atmosphere 108*o* opened to the bottom surface of the cartridge main body 102, as the starting end; an upstream side elongated groove 108*a* which meanders while changing direction several times; a downstream side elongated groove 108*c* which has the communicating hole 108*h* shown in FIG. 3 as the termination; and an approximately rectangular intermediate groove 108*b* which is provided between the upstream side groove 108*a* and the downstream side groove 108*c* and formed in a shallow concave shape, or the like. In addition, an upstream side air passage is formed by the upper side groove 108*a* and the display label 120 if sticking the display label 120 onto the front side of the ink cartridge 100, an air reservoir is formed by the intermediate groove 108*b* and the display label 120, and a downstream side air passage is formed by the downstream side groove 108*c* and the display label 120. Moreover, the surface configuration of the pressure regulation chamber 107 is shown in the vicinity (right side in FIG. 4) of the groove 108.

Figure 5:
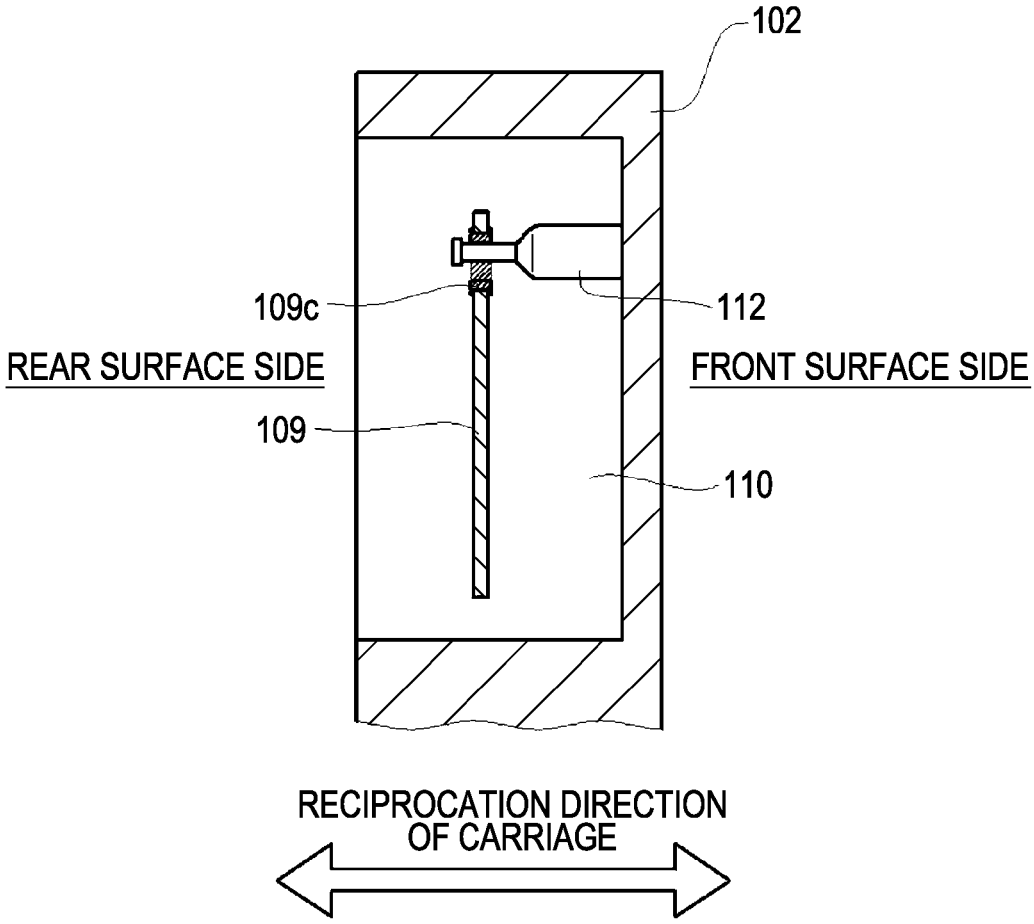
FIG. 5 is an explanatory view showing a stirring mechanism of ink which is provided in an ink chamber.

FIG. 5 is an explanatory view showing a stirring mechanism of ink which is provided in the ink cartridge 100 of the embodiment. FIG. 5 shows a state when viewing a cross-section, which is taken along a line V-V with respect to the region 105*b* which becomes the second ink chamber shown in FIG. 3, in the arrow of the line. Moreover, as described above, in the ink cartridge 100 of the embodiment, the ink stirring mechanism is also provided at the region 105*a* which becomes the first ink chamber (refer to FIG. 3). However, the configurations of the stirring mechanisms are the same as each other, and the ink stirring mechanism in the second ink chamber will be explained as the example below. Moreover, in the below explanation, the second ink chamber is simply referred to as an ink chamber.

As shown in FIG. 5, a hole is provided at one end side of a stirring plate 109 which is provided in the ink chamber 110, and a rubber buffer member 109*c* is mounted on the inner edge portion of the hole. In addition, the stirring plate 109 is supported into the ink chamber 110 in a state of having a gutter by engaging the hole of the stirring plate 109 on which the buffer member 109*c* is mounted to a protrusion 112 which is provided at the inner wall of the ink chamber 110.

When the ink cartridge 100 including the ink stirring mechanism of the embodiment is mounted on the carriage 10, the ink cartridge 100 is reciprocated in a side surface direction (direction indicated by an arrow in FIG. 5) according to the reciprocation of the carriage 10. At this time, the stirring plate 109 in the ink cartridge 100 is swung with the movement of the ink cartridge 100. As described above, since the stirring plate 109 is formed of a material (stainless-steel in the embodiment) having a sufficiently greater specific gravity than the ink, the stirring plate 109 is swung in the left and right direction in the drawing while pushing the ink in the ink chamber 110 with a position which engages the hole of the stirring plate 109 and the protrusion 112 as the supporting point. As a result, since the stirring plate can stir so as to mix in the components of the ink which have settled below (that is, in the gravity direction in the state where the ink cartridge 100 is mounted on the carriage 10) in the drawing in the ink chamber 110, it is possible to uniformly maintain a concentration of the ink in the ink chamber 110.

Moreover, since a gutter (predetermined gap) is provided between the hole of the stirring plate 109 and the protrusion 112 which engages the hole, the fixation of the stirring plate 109 to the protrusion 112, which is generated by thickening of the ink entering the gap between the hole of the stirring plate 109 and the protrusion 112, is not generated.

Certainly, in the configuration, there is a concern that the stirring plate 109 which is swung in the ink cartridge 100 may collide with the inner wall of the ink cartridge 100 and noise may be generated. However, in the ink cartridge 100 of the embodiment, as described above, the buffer member 109*c* is provided at the inner edge portion of the hole which engages the stirring plate 109 to the protrusion 112 of the ink chamber 110 (refer to FIG. 5). Thereby, it is possible to suppress the noise which is generated by stirring of the ink. That is, it is expected that the vicinity of the tip of the stirring plate 109 will collide with the inner wall of the ink cartridge 100 when the stirring plate 109 is swung. However, actually, providing the buffer member 109*c* in the inner edge portion of the hole which engages the stirring plate 109 is more effective in the suppression of noise than providing the buffer member in the vicinity of the tip of the stirring plate 109. This point will be explained below.

B. Reason why Noise Due to Stirring of Ink is Suppressed

Figure 6A:
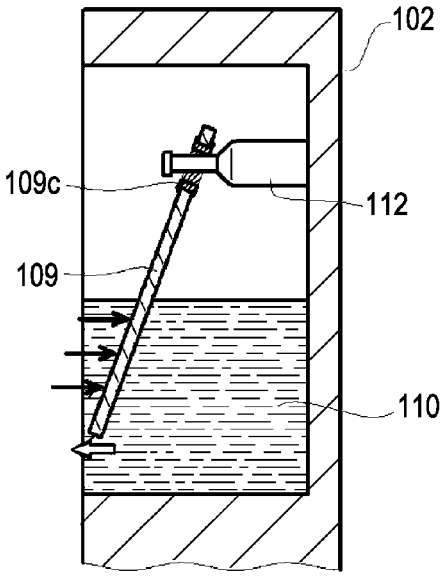
FIGS. 6A to 6C are explanatory views showing a reason why noise during stirring of the ink is effectively suppressed by providing a buffer member to a hole of a stirring plate.
Figure 6B:
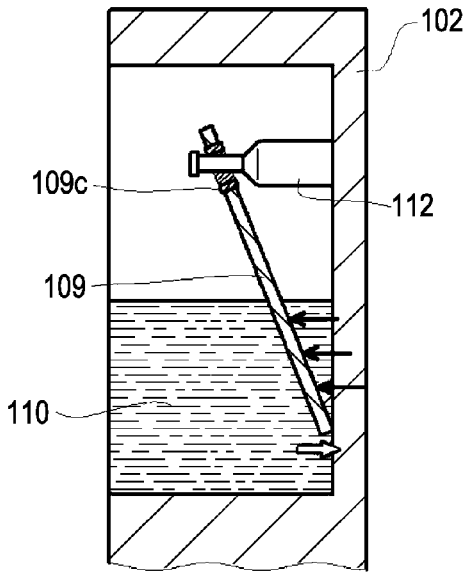
Figure 6C:
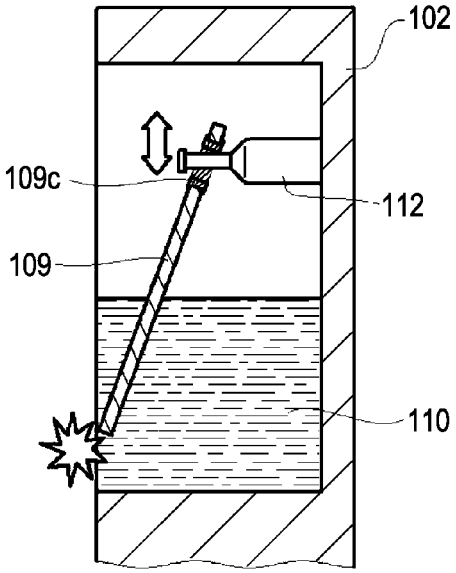

FIGS. 6A to 6C are explanatory views showing a reason why noise during stirring of the ink is effectively suppressed by providing a buffer member 109*c* to a hole which engages the stirring plate 109 to a protrusion 112. For the explanation, FIGS. 6A to 6C show the movement of the stirring plate 109 which generates noise during stirring the ink.

First, as shown in FIGS. 6A and 6B, when the stirring plate 109 moves in the direction which stirs the ink, there is a concern that the tip of the stirring plate 109 may collide with the inner wall of the ink chamber 110 and collision noise may be generated. However, actually, the noise generated in this manner is not so great. On the other hand, the tip of the stirring plate 109 collides with the inner wall of the ink chamber 110, and the stirring plate vibrates with respect to the protrusion 112 which is a support structure with the stirring plate 109. Therefore, due to the fact that the inner edge portion of the hole of the stirring plate 109 and the protrusion 112 collide with each other at the time of the vibration, collision noise is generated. Thus, the collision noise is the major example of noise which is generated when the ink is stirred. FIG. 6C shows the state where the stirring plate 109 vibrates with respect to the protrusion 112 which is the support structure due to the fact that the tip of the stirring plate 109 collides with the inner wall of the ink chamber 110.

As described above, it is considered that the major cause of the noise generated during the stirring of the ink is the collision noise generated when the hole of the stirring plate 109 and the protrusion 112 collide with each other at the time of the stirring due to the fact that the stirring plate 109 vibrates when the stirring plate 109 collides the ink chamber 110. Therefore, since the impact at the time of the collision of the stirring plate 109 and the protrusion 112 can be suppressed by providing the buffer member 109*c* in the inner edge portion of the hole of the stirring plate 109, it is possible to decrease the major noise (collision noise of stirring plate 109 and protrusion portion 112). As a result, it is possible to effectively suppress the noise generated during the stirring of the ink.

C. Modification

In the above-described embodiment, some modifications are considered. Hereinafter, the modifications will be simply described. Moreover, in the modifications described below, the same components as the above-described embodiment are denoted by the same reference numerals as the embodiment, and detailed explanation will be omitted.

C-1. First Modification

In the above-described embodiment, the case where the buffer member 109*c* is provided at the inner edge portion of the hole which engages the stirring plate 109 to the protrusion 112 of the ink chamber 110 is explained. Here, the buffer member 109*c* may be provided at the protrusion 112 side instead of providing the buffer member 109*c* in the stirring plate 109.

Figure 7A:
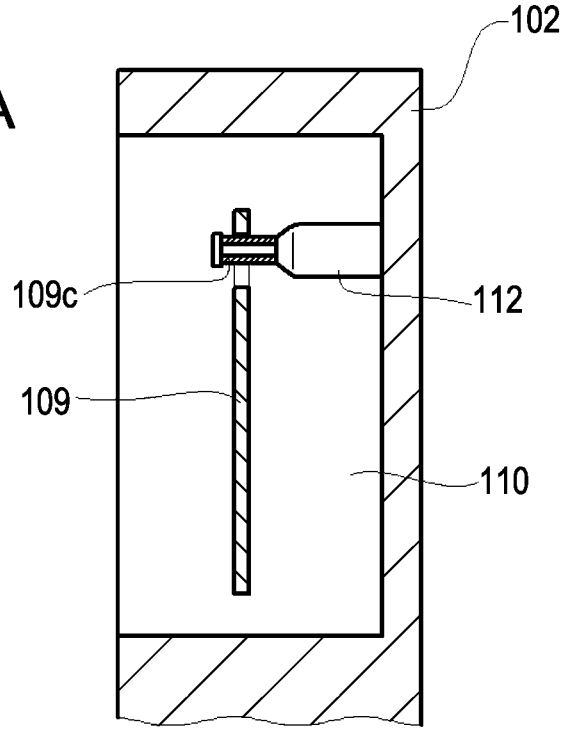
FIGS. 7A and 7B are explanatory views showing an inner structure of an ink chamber of a first modification.
Figure 7B:
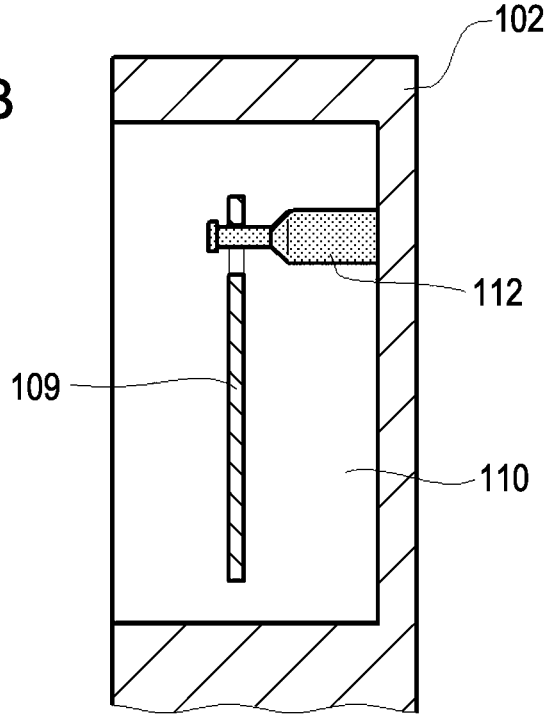

FIGS. 7A and 7B are explanatory views showing the inner structure of the ink chamber 110 of the ink cartridge 100 of a first modification. In the protrusion 112 in the ink chamber 110 shown in FIG. 7A, the portion, in which the hole of the stirring plate 109 is engaged to the protrusion 112, is covered by the rubber buffer member 109*c*. Thus, similarly to the ink stirring mechanism shown in FIG. 5, since the impact when the stirring plate 109 and the protrusion 112 collide with each other can be suppressed, it is possible to effectively suppress the noise during the stirring of the ink. Moreover, as shown in FIG. 7B, if the protrusion 112 itself is formed of a rubber material, the same effects as those of the above-described case can be obtained, and the operation which separately mounts the buffer member 109*c* to the stirring plate 109 (or protrusion 112) may not be performed. Therefore, the manufacture of the ink cartridge 100 can be simply performed.

C-2. Second Modification

In the embodiment and the first modification described above, the case where the buffer member 109*c* is provided only between the hole which engages the stirring plate 109 to the protrusion 112 and the protrusion 112 is explained. Here, if the buffer member 109*c* is added to the following positions, it is possible to further suppress the noise which is generated during the stirring of the ink.

Figure 8A:
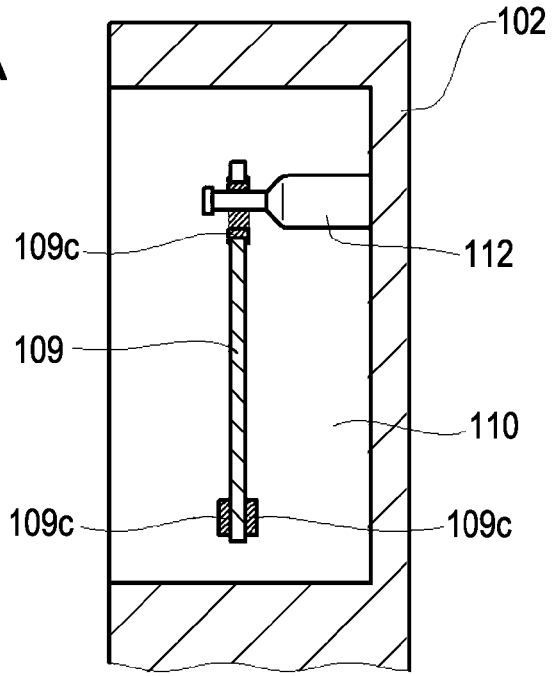
FIGS. 8A and 8B are explanatory views showing an inner structure of an ink chamber of a second modification.
Figure 8B:
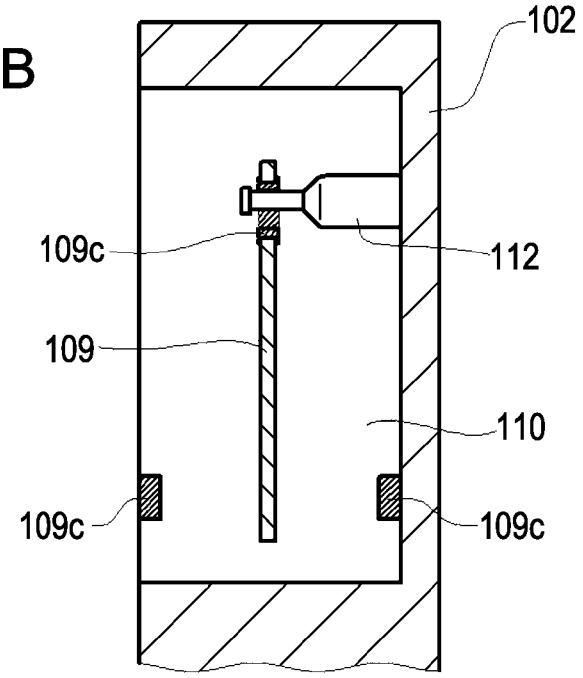

FIGS. 8A and 8B are explanatory views showing the inner structure of the ink chamber 110 of the ink cartridge 100 of a second modification. In the stirring plate 109 shown in FIG. 8A, the buffer member 109*c* is provided at the position (lower end of stirring plate 109) at which the stirring plate 109 and the inner wall of the ink chamber 110 collide with each other when the stirring plate 109 swings through the inertial force. Moreover, in FIG. 8B, the buffer member 109*c* is provided at the position at which the stirring plate 109 collides with the inner wall side of the ink chamber 110.

As described above, a small collision noise is generated even though the stirring plate 109 and the inner wall of the ink chamber 110 collide with each other (refer to FIGS. 8A and 8B). Accordingly, if the buffer member 109*c* is provided at the position at which the inner wall of the ink chamber 110 and the stirring plate 109 collide with each other, it is possible to further suppress the noise during the stirring of the ink.

C-3. Third Modification

In the second modification described above, the case where the buffer members 109*c* are separately provided at the inner edge portion of the hole of the stirring plate 109 and the portion at which the inner wall of the ink chamber 110 and the stirring plate 109 collide with each other is explained. However, the buffer members 109*c* may be integrally formed.

Figure 9:
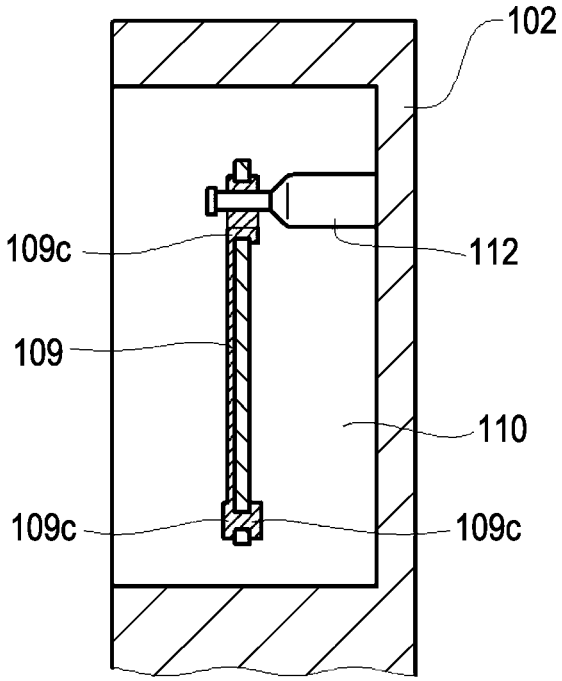
FIG. 9 is an explanatory view showing an inner structure of an ink chamber of a third modification.

FIG. 9 is an explanatory view showing the inner structure of the ink chamber 110 of the ink cartridge 100 of a third modification. In the stirring plate 109 of the third modification shown in FIG. 9, the buffer member 109*c* which is provided at the inner edge portion of the hole of the stirring plate 109 is connected to the buffer member 109*c*, which is provided at the portion at which the inner wall of the ink chamber 110 and the stirring plate 109 collide with each other, by a rubber and the buffer members are integrally formed. If the buffer members 109*c* are formed in this way, since the entire buffer member 109*c* can be mounted on the stirring plate 109 in the mounting operation once when the buffer member 109*c* is mounted on the stirring plate 109, it is possible to simply manufacture the ink cartridge 100.

C-4. Fourth Modification

Figure 10:
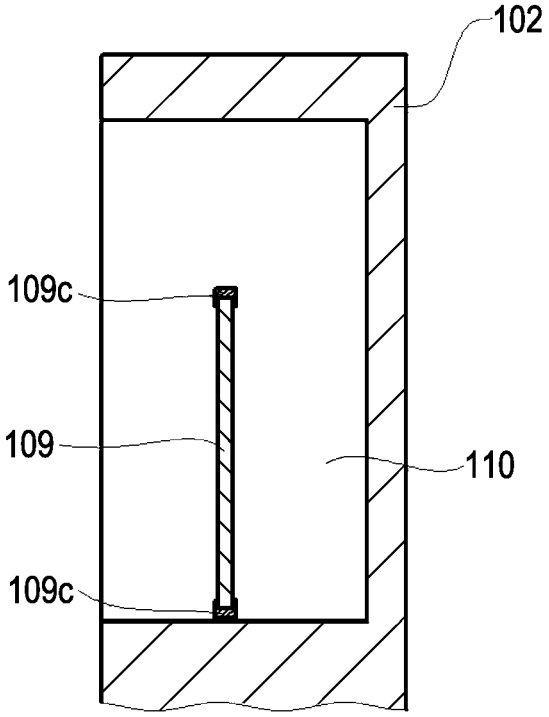
FIG. 10 is an explanatory view showing an inner structure of an ink chamber of a fourth modification.

In the embodiment and the modifications described above, the case where the stirring plate 109 is engaged to the protrusion 112 in the ink chamber 110 is explained. However, the stirring plate 109 may be accommodated in the ink chamber 110 in a state of being capable of swinging by the reciprocation of the carriage 10. For example, as shown in FIG. 10, the stirring plate 109 may be only put in the ink chamber 110. Even though when the stirring plate is provided in this way, the stirring plate can stir in the ink chamber 110 due to the fact that the stirring plate 109 swings according to the reciprocation of the carriage 10. Moreover, as shown in FIG. 10, if the buffer member 109*c* is provided at the upper end side and the lower end side of the stirring plate 109 respectively, as described above, since the collision noise can be suppressed when the stirring plate 109 vertically swings (refer to FIG. 6C) and collides with the upper surface or the lower surface of the ink chamber 110, it is possible to effectively suppress the noise during the stirring of the ink.

As described above, various embodiments are described. However, the invention is not limited to all the above-described embodiments and can be performed in various aspects within the scope which does not depart from the gist. For example, in the embodiment and the modifications described above, the case where the rubber material is used for the buffer member is described. However, any other materials may be used if the material can absorb an impact.

What is claimed is:

1. A liquid storage container which is mounted on a carriage of a liquid ejecting apparatus ejecting a liquid while reciprocating the carriage on which an ejecting head is provided and supplies the liquid to the ejecting head comprising:

a liquid storage chamber, mounted on a carriage, configured to store the liquid therein;

a stirring member that has a stirring surface and provided in the liquid storage chamber in a state capable of being swung by the reciprocation of the carriage;

a support member that supports the stirring member, wherein the stirring member is a member in which a hole is provided on at least a portion of a plate-shaped member, and which is supported in the state capable of being swung in the liquid storage chamber due to the fact that the hole is engaged to a protrusion which is the support structure and provided in the liquid storage chamber; and a first buffer member provided between the support member and the stirring member on an inner edge portion of the hole of the stirring member.

2. The liquid storage container according to claim 1, wherein the stirring member is a member in which a hole or a notch is provided on at least a portion of a plate-shaped member, and which is supported in the state capable of being swung in the liquid storage chamber due to the fact that the hole or the notch is engaged to a protrusion which is the support structure and provided in the liquid storage chamber, and the first buffer member is a member which is provided between the hole or the notch of the stirring member and the protrusion in the liquid storage chamber.

3. The liquid storage container according to claim 2, wherein a second buffer member is provided on an inner surface of the liquid storage chamber which faces the stirring surface.

4. The liquid storage container according to claim 2, wherein the first buffer member is provided at the protrusion.

5. The liquid storage container according to claim 2, wherein the second buffer member is provided on the stirring surface of the stirring member.

6. The liquid storage container according to claim 5, wherein the first buffer member and the second buffer member are integrally formed with each other and mounted on the stirring member.

7. The liquid storage container according to claim 1, wherein the stirring member is formed of a material having a greater specific gravity than a specific gravity of the liquid.

8. A liquid storage container which is mounted on a carriage of a liquid ejecting apparatus ejecting a liquid while reciprocating the carriage on which an ejecting head is provided and supplies the liquid to the ejecting head comprising:

a liquid storage chamber, mounted on a carriage, configured to store the liquid therein;

a stirring member that has a stirring surface and provided in the liquid storage chamber in a state capable of being swung by the reciprocation of the carriage;

a support member that supports the stirring member; and a first buffer member provided between the support member and the stirring member;

wherein the stirring member is a member in which a hole or a notch is provided on at least a portion of a plate-shaped member, and which is supported in the state capable of being swung in the liquid storage chamber due to the fact that the hole or the notch is engaged to a protrusion which is the support structure and provided in the liquid storage chamber, and wherein the first buffer member is a member which is provided between the hole or the notch of the stirring member and at the protrusion in the liquid storage chamber.

9. The liquid storage container according to claim 8, wherein the stirring member is a member in which a hole is provided on at least a portion of a plate-shaped member, and which is supported in the state capable of being swung in the liquid storage chamber due to the fact that the hole is engaged to a protrusion which is the support structure and provided in the liquid storage chamber, and the first buffer member is a member which is provided on an inner edge portion of the hole of the stirring member.

* * * * *